US006131903A

United States Patent [19]

Schaefer et al.

[11] Patent Number: 6,131,903

[45] Date of Patent: Oct. 17, 2000

[54] SIGNATURE STRIPPING MECHANISM

[75] Inventors: Karl P. Schaefer, Brookfield; Ingermar S. d'Agrella, Sussex; John M. Neary, Hartland; Richard J. Fox, Menomonee Falls, all of Wis.

[73] Assignee: Quad/Tech, Inc., Sussex, Wis.

[21] Appl. No.: 09/357,633

[22] Filed: Jul. 20, 1999

[51] Int. Cl.[7] ..... B65H 29/54

[52] U.S. Cl. ..... 271/312; 271/187; 271/315

[58] Field of Search ..... 271/307, 312, 271/313, 187, 315

[56] References Cited

U.S. PATENT DOCUMENTS

| | | | |
|---|---|---|---|
| 4,222,556 | 9/1980 | Chapman et al. | 271/307 X |
| 4,357,008 | 11/1982 | Campbell | 271/315 |
| 4,434,979 | 3/1984 | Kobler et al. | 271/307 |
| 4,861,019 | 8/1989 | Michalik | 271/307 X |
| 4,886,264 | 12/1989 | Haensch | 271/312 X |
| 5,083,768 | 1/1992 | Ertavi et al. | 271/182 |
| 5,156,389 | 10/1992 | Novick | 271/187 |
| 5,236,188 | 8/1993 | Breton et al. | 271/187 |
| 5,249,791 | 10/1993 | Belanger et al. | 271/182 |
| 5,611,530 | 3/1997 | Maresse et al. | 271/315 |
| 5,730,435 | 3/1998 | Belanger et al. | 270/52.14 |

*Primary Examiner*—David H. Bollinger
*Attorney, Agent, or Firm*—Michael Best & Friedrich LLP

[57] ABSTRACT

An adjustable signature stripping mechanism for stripping signatures from a rotating bucket assembly in a folder of a printing press. The mechanism includes a stripper shaft having a mounting portion and a pivot axis and a plurality of strippers mounted on the stripper shaft for stripping signatures from the bucket assembly and wherein the strippers are non-rotatable relative to the stripper shaft and slidable positionable along the stripper shaft.

20 Claims, 10 Drawing Sheets

9
10
11
12
13
14
15
17
19
21
23
25
27
29
126
128
130
138
140
124
125
146

SIGNATURE STRIPPING MECHANISM

FIELD OF THE INVENTION

The present invention relates to a signature stripping mechanism, and more particularly, to an adjustable signature stripping mechanism for stripping signatures from the buckets of folders.

BACKGROUND OF THE INVENTION

Stripping mechanisms are utilized in folders of printing presses to push or strip signatures out of rotating buckets such that the signatures are deposited onto a conveyor. Stripping mechanisms generally include a plurality of individual strippers.

A bucket assembly typically includes a plurality of buckets rotating on a common bucket shaft. The buckets are spaced axially along the shaft. The strippers are designed to reach between the rotating buckets. When a signature enters a bucket assembly and is stripped from the buckets, it touches all buckets and all strippers along its width. In folders having buckets that are adjustable to accommodate varying widths of signatures, the stripping mechanism also needs to be adjustable. The stripping mechanism should be adjustable to locate the stripping surface of each of the strippers similarly and at ideally the best angle and best location relative to the rotating path of the signatures as the signatures turn in the rotating buckets. For example, a specific job may require four buckets with three strippers placed therebetween. The goal of adjusting the three strippers is to set each stripper at the same location and same angle as each of the other strippers so they are aligned. This is typically difficult to accomplish because each stripper has its own individual adjustments.

Some prior art stripping mechanisms are adjustable using an arrangement that controls more than one degree of freedom of movement of an individual stripper with respect to a shaft; e.g., both axial sliding and rotating. Due to the two degrees of freedom of movement in such an arrangement, the adjustment can be difficult to perform. For example, if an operator only wants to slide the individual stripper axially along the shaft, when a handle is loosened, the stripper may also inadvertently rotate about its shaft. Having too many degrees of freedom in a stripper adjustment can make an individual adjustment more difficult to perform.

Another problem that exists with some stripping mechanisms relates to how far the adjustment mechanism sticks out towards the next adjacent stripper. It is desirable to have buckets that are close together and strippers that reach between the buckets because these conditions make for better high-speed signature handling in the folder. However, if an adjustment handle sticks out too far towards the adjacent stripper, it becomes awkward and/or impossible to adjust the bucket assembly and the adjacent strippers because there is not enough room between the buckets for a press operator to adjust each stripper.

Additionally, some stripping mechanisms are only adjustable when the folder is stopped, or the adjustments are more difficult and dangerous to make while the folder is running. The ideal time to adjust the strippers is while the folder is running because the operator can see what effect the adjustment has on how the signatures are being stripped from the buckets. Adjusting the stripping mechanism while the folder is running provides immediate feedback on whether the adjustment is improving how the signatures are being stripped.

Before the press operator starts adjusting the stripping mechanism, the operator must have knowledge of the best location and the best angle of the strippers so that the folder can run at its fastest speed without damaging the signatures that are being processed and stripped from the buckets. Strippers can damage signatures running at high speeds if the strippers are adjusted to the wrong location or to the wrong angle. Proper positioning of the strippers typically requires much press experience and knowledge. For example, if an inexperienced press operator adjusts the strippers to a location and angle that is less than optimum, this slows down the processing speed of the signatures and/or may damage the signatures.

Further, it is desirable that installation or removal of the stripping mechanism from the folder be easy and fast to perform. Often, this installation or removal is a slow, difficult process. When the folder is not running, profits on the production line which includes the printing press, folder, stackers, and press personnel are lost. Therefore, the goal is to keep the down time of the press to a minimum, and to set the folder up, including installing or removing the stripping mechanism, as quickly as possible for different signature width jobs.

SUMMARY OF THE INVENTION

The invention provides an improved signature stripping mechanism for stripping signatures from a bucket assembly in a folder of a printing press. The stripping mechanism includes a plurality of strippers mounted to a shaft assembly which is mounted to the folder using a mount assembly. Each stripper is axially adjustable along the shaft assembly.

In one embodiment, the shaft assembly is pivotally adjustable to simultaneously adjust the angle of all of the strippers mounted on the shaft assembly. Additionally, the strippers have two independent adjustments, axial and pivotal, so the strippers are easier and quicker to adjust relative to the respective bucket assembly. Dependent adjustments have been designed out of the stripping mechanism to make it easier for the press operator to achieve the correct adjustment more quickly and more accurately.

It is one feature of the present invention to provide an improved signature stripping mechanism wherein the individual strippers are each axially adjustable along a common shaft assembly.

It is another feature of the present invention to provide a signature stripping mechanism that is safely adjustable while the folder is running.

It is another feature of the present invention to provide a signature stripping mechanism wherein the individual strippers are easily and quickly adjustable.

It is another feature of the present invention to provide a signature stripping mechanism that includes individual strippers that are all simultaneously pivotally adjustable relative to an adjacent bucket assembly.

It is another feature of the present invention to provide a signature stripping mechanism where the angle of the stripping surface on all the strippers can be adjusted simultaneously with one adjustment.

It is another feature of the present invention to provide a signature stripping mechanism where the stripping surface angle and location of all of the individual strippers are automatically aligned with one another.

It is another feature of the present invention to provide a signature stripping mechanism that requires little press experience to optimally adjust.

It is another feature of the present invention to provide a signature stripping mechanism wherein each stripper is easy to adjust because the number of degrees of freedom of movement for each adjustment is reduced.

It is another feature of the present invention to provide a signature stripping mechanism wherein individual strippers can be easily and quickly added or removed from the folder in order to process various widths of signatures.

It is another feature of the present invention to provide a signature stripping mechanism where individual strippers can be moved close together when narrow signatures are being processed in the folder.

Other features and advantages of the invention will become apparent to those of ordinary skill in the art upon review of the following detailed description, claims and drawings.

Figure 1:
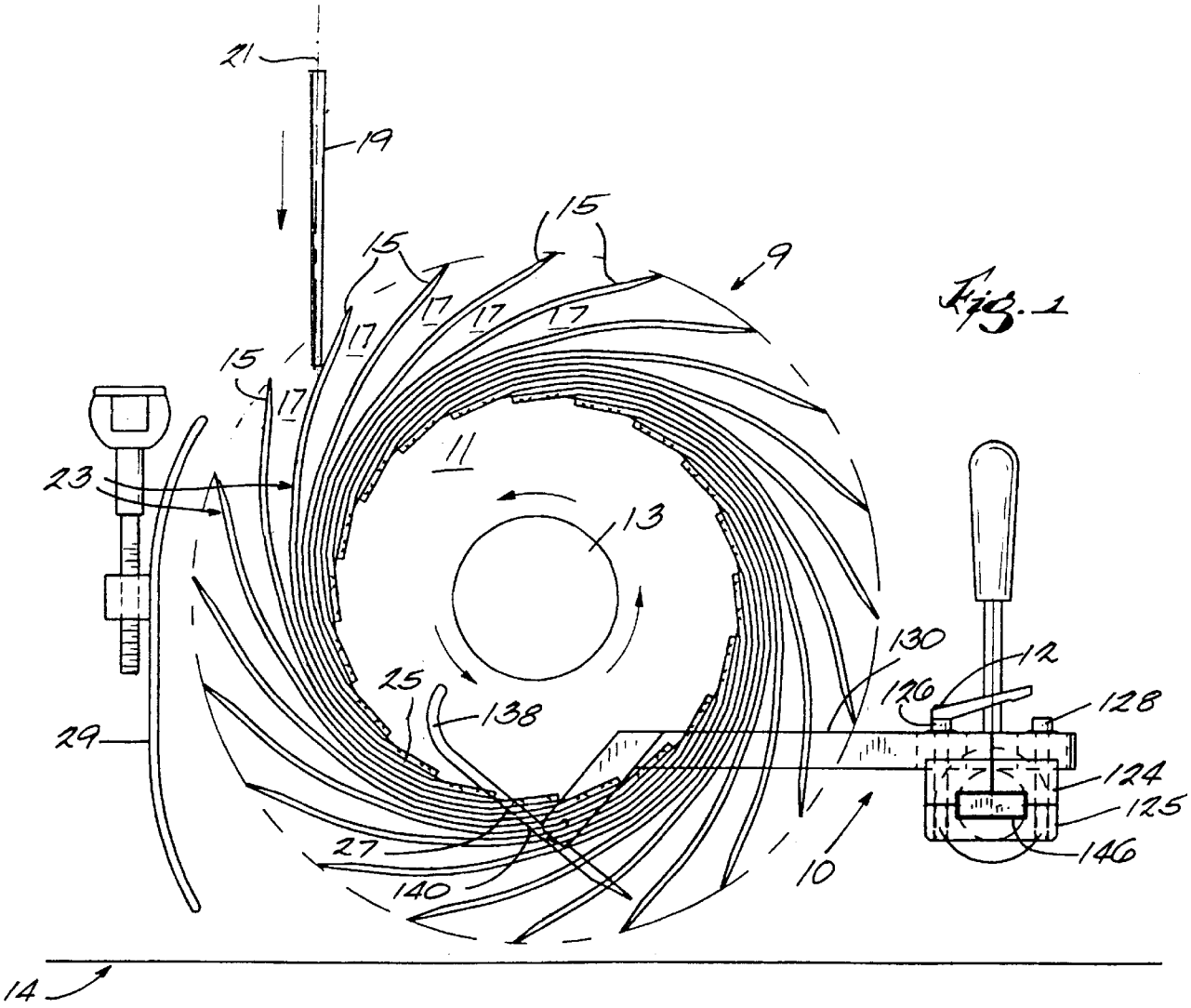
FIG. 1 is a side view of a bucket and a stripper of a first embodiment of a signature stripping mechanism.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Referring now to FIG. 1 of the drawings, a first embodiment of a signature stripping mechanism 10 embodying the invention is shown in conjunction with a bucket assembly 9 in a folder. The bucket assembly 9 includes a plurality of buckets 11 (only one of which is shown in FIG. 1) mounted in spaced apart relation on a shaft 13. The buckets 11 are rotatable around the shaft 13 in the direction of the arrows. The buckets 11 include a plurality of blades 15 defining slots 17 for receiving signatures.

The general operation of the stripping mechanism 10 is as follows. Printed products such as signatures 19 are sequentially fed in spaced apart relation along line 21 (typically by tapes, not shown) into successive slots 17 as the buckets 11 rotate around shaft 13. Each signature 19 slides along blade edges 23 of its respective slot until the leading edge of the signature 19 hits a slot end 25. The bucket continues to rotate through an additional 10–30 degrees before the signature 19 then hits a stripping surface 27 of the stationary stripping mechanism 10. As the bucket continues to rotate, the signature 19 is pushed completely out of the bucket slot 17 and falls onto a conveyor 14. Signature guide 29 helps to confine and guide the signature 19 as the signature exits the bucket slot 17. The conveyor 14 operates to transport the signatures in preferably a shingled orientation from the folder toward a stacker or other processing equipment (not shown). In this manner, the signatures are removed from the folder.

Figure 3:
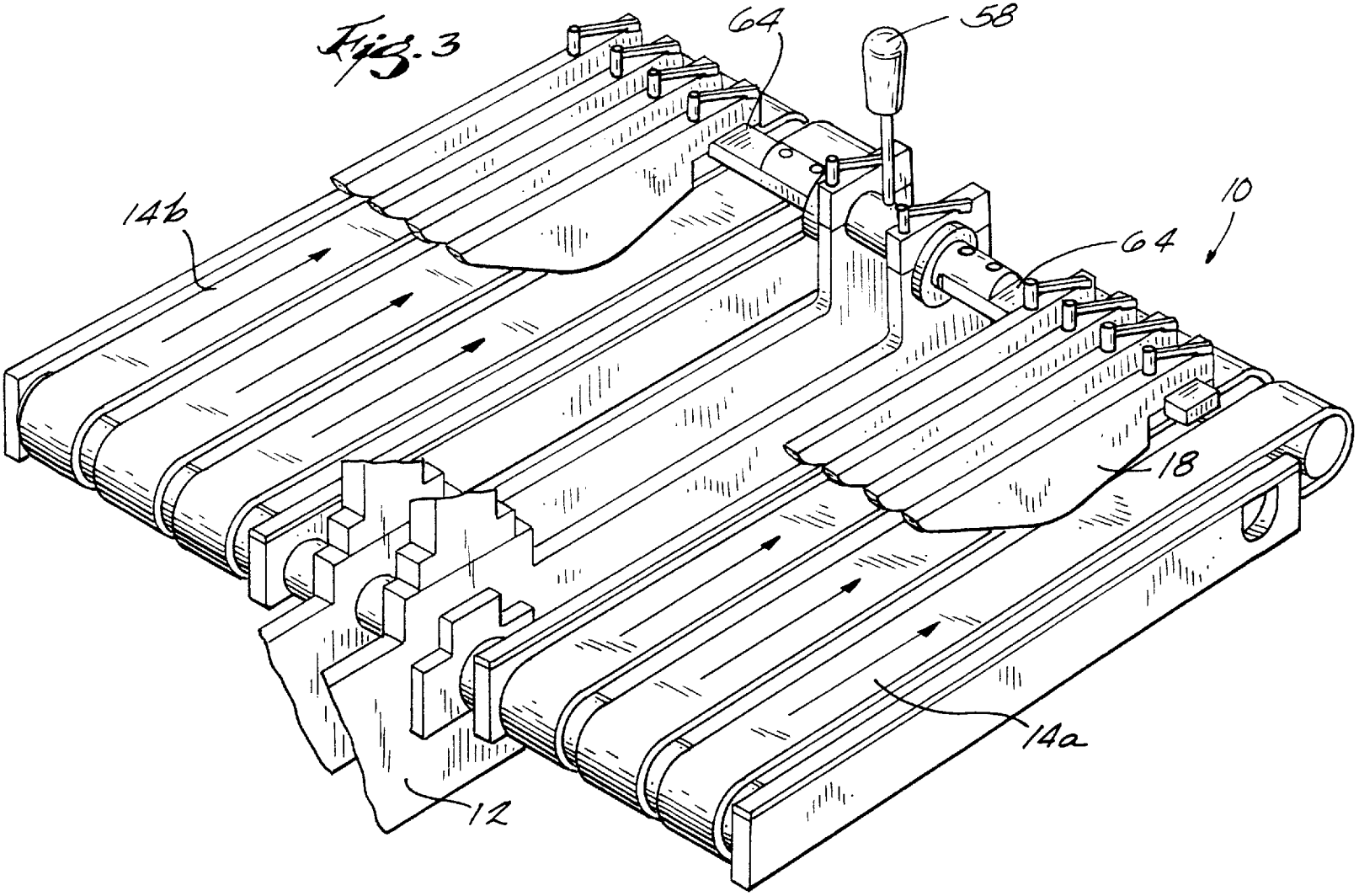
FIG. 3 is a perspective view of a second embodiment of the signature stripping mechanism mounted to a portion of a folder of a printing press.

FIG. 3 illustrates a second embodiment of the stripping mechanism 10 mounted to a portion of folder 12 of a printing press. Here stripping mechanism 10 is illustrated as being appropriate for use on a folder having two rotating bucket assemblies (not shown) that deposit signatures onto two conveyors 14*a*, 14*b*. Again, the conveyors 14*a* and 14*b* transport the signatures in preferably a shingled orientation from the folder 12 toward a stacker or other processing equipment (not shown).

Figure 4:
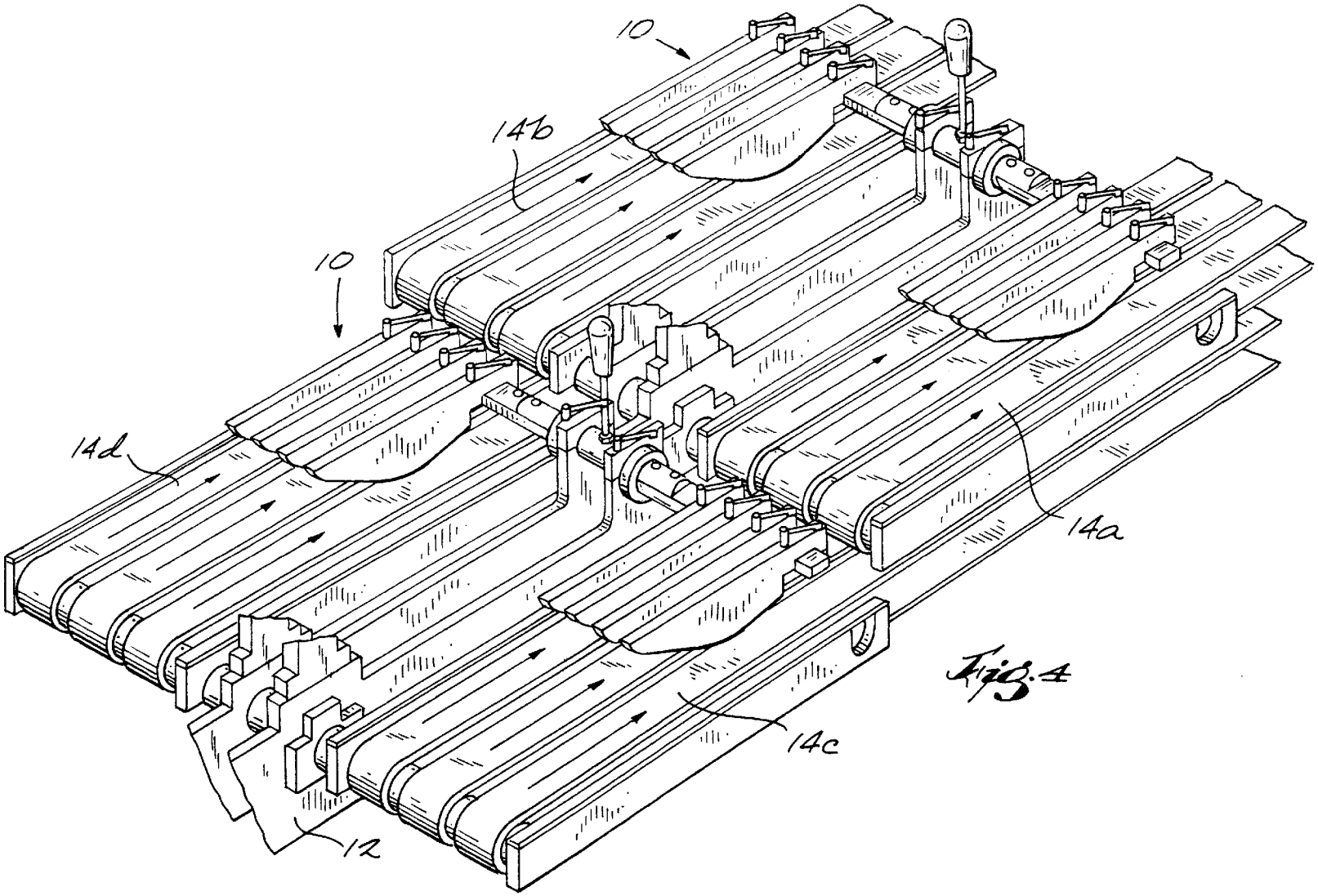
FIG. 4 is a perspective view of two signature stripping mechanisms mounted to a portion of the folder.

As shown in FIG. 4, two sets of signature stripping mechanisms 10 can be utilized on a folder 12 having four bucket assemblies (not shown) and four conveyors 14*a*, 14*b*, 14*c* and 14*d*. In other words, the signature stripping mechanism 10 of the present invention can be configured to be used in conjunction with one or more bucket assemblies and one or more conveyors.

Figure 2:
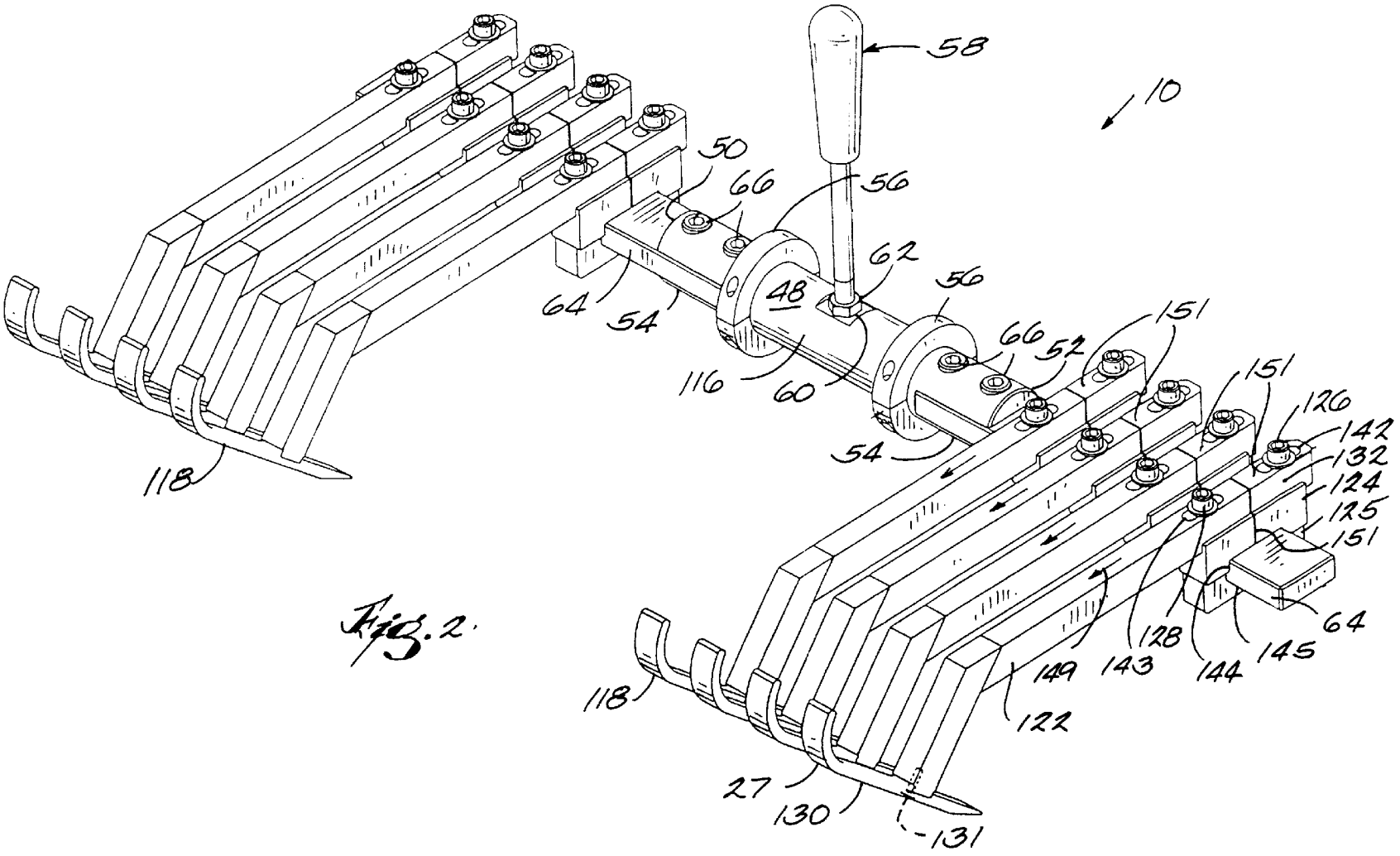
FIG. 2 is a perspective view of the first embodiment of the signature stripping mechanism.

Turning now to FIGS. 1, 2, and 13, the first embodiment of the signature stripping mechanism 10 will be described. Stripping mechanism 10 preferably includes a shaft assembly 116 and a plurality of strippers 118 slidably mountable on the shaft assembly 116. FIG. 2 illustrates eight strippers slidably mounted to the shaft assembly 116. However, it should be noted that any desired number of strippers 118 can be mounted to the shaft assembly 116 depending upon the number of buckets used which will depend upon the width of the signatures being processed. A mount assembly for pivotally mounting the shaft assembly 116 to the folder 12 is not shown; however, an appropriate mount assembly is described below in connection with the second embodiment of the signature stripping mechanism 10.

The shaft assembly 116 includes a center shaft 48 having ends 50 and 52. Each end 50, 52 includes a C-shaped slot 54. The two C-shaped slots 54 are in line with each other. An axially adjustable collar 56 is mounted around the center shaft 48 adjacent each end 50, 52. A handle 58 extends radially outwardly from the center shaft 48 and is secured to a recess 60 in the center shaft 48 with threads and a nut 62. A rectangular bar 64 is positioned at each end 50, 52 of the center shaft 48 such that one bar 64 is housed in each C-shaped slot 54. A pair of screws 66 secure the bars 64 to each respective end 50, 52 of the center shaft.

An advantage to having a center shaft 48 and two bars 64 secured thereto is that the separate pieces simplify the assembly process of the shaft assembly on the folder 12. Typically obstructions, such as machine walls, make it difficult to assemble a long, one-piece shaft assembly into the folder. With the separate pieces, the center shaft 48 is first mounted to the folder 12, and then the bars 64 are secured thereto. Of course, the shaft assembly alternately could also be machined from one piece of metal, but this would not be as easy to assemble.

Each stripper 118 includes a support arm 122, ski portion 130, U-shaped brackets 124, 125, and adjustment screws 126 and 128. The support arm 122 supports the ski portion 130 via a screw 131 and includes a mounting portion 132. The ski portion 130 is configured to optimally strip signatures from bucket assemblies thus permitting a faster running speed of the folder 12. The ski portion 130 includes a stripping surface 27. Stripping surface 27 can take a variety of shapes. In this embodiment, stripping surface 27 is shown as being ski-shaped, having a first curved portion 138 and a second portion 140 that is the primary stripping surface for stripping a signature from a rotating bucket assembly. The mounting portion 132 of the support arm 122 is generally rectangular in cross section and includes two slots 142, 143 for receiving the screws 126, 128.

The brackets 124 and 125 each include a respective rectangular notch 144, 145. The bracket 124 is aligned with the bracket 125 such that the rectangular notch 144 is adjacent to and aligned with the rectangular notch 145 of the bracket 125. The aligned two notches 144 and 145 form a rectangular aperture 146 through which the bar 64 extends and which prevents rotation of stripper 118 around the axis of the shaft assembly 116.

Figure 12:
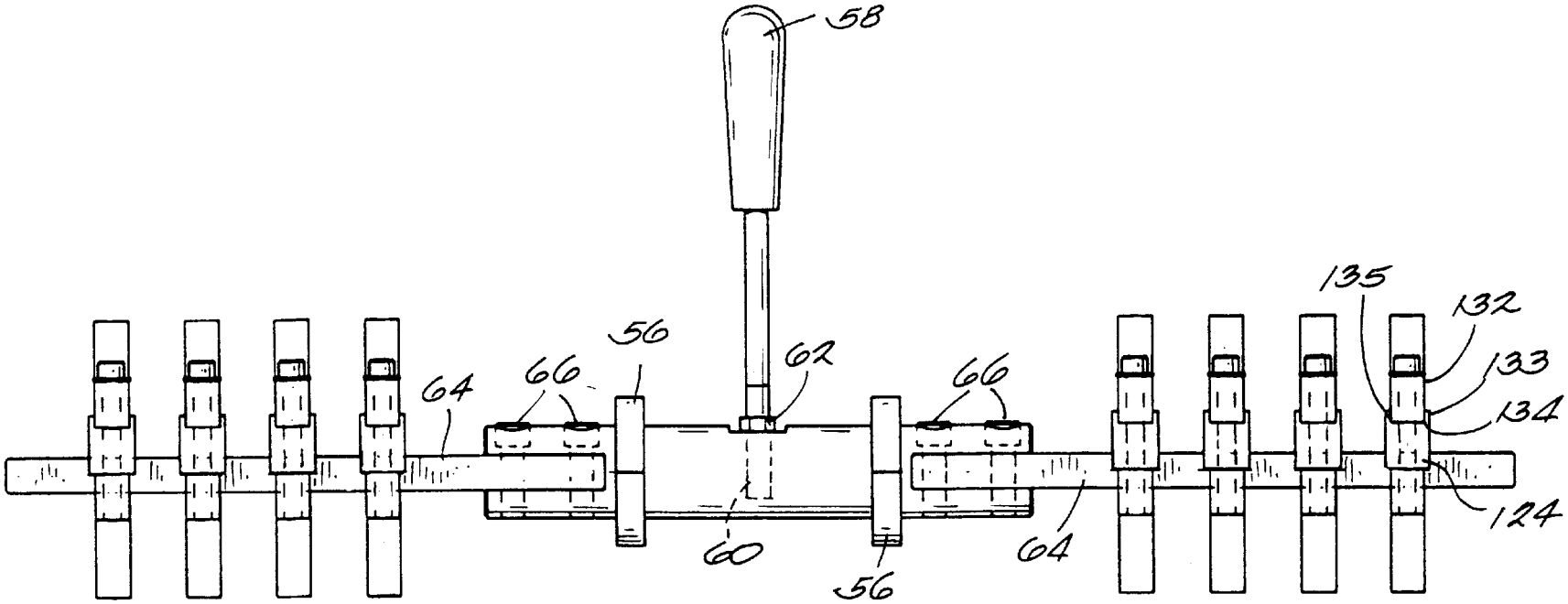
FIG. 12 is a front view of the first embodiment of the signature stripping mechanism.

As best seen in FIG. 12, bracket 124 also includes a notch 133 extending along its length defining two guide walls 134, 135. The mounting portion 132 fits within the guide walls 134, 135 and is constrained therein such that movement of the mounting portion 132 is permitted in the direction denoted by the arrows 149 in FIG. 2. As shown in FIG. 2, the screws 126, 128 extend through the slots 142, 143 of the mounting portion 132, through clearance holes of bracket 124, and into the tapped bracket 125. These screws can also include handles such as described below and when tightened, prevent axial movement of the stripper 118 along the shaft assembly 116 and movement perpendicular to the axis of the shaft assembly (in the direction of arrow 149).

Lines 151 are placed on the top and both sides of mounting portion 132 of each stripper 118 and on the sides of each bracket 124. These lines are used to align each of the strippers with each other in the direction perpendicular to the axis of the shaft assembly 116.

To mount the strippers 118 on the shaft assembly 116, the rectangular aperture 146 is positioned to surround one of the bars 64 by sliding the stripper 118 onto the bar 64. In this orientation, the rectangular notches 144, 145 in brackets 124, 125 of the stripper 118 fit tightly around one of the bars 64. The notches 144, 145 align each stripper 118 so that all of the strippers 118 on the bar 64 can be aligned in the same orientation with respect to bar 64 and thus to each other. This orientation also places the stripping surface 27 of each stripper 118 at the correct location and angle with respect to the bucket assembly 9 and with respect to the signatures 19 that are processed through the bucket assembly 9.

When the screws 126, 128 are in an unlocked or loosened position, the stripper 118 is axially slidable along the bar 64 and can also be moved in a direction perpendicular to the axial direction. Thus, each stripper 118 has two degrees of freedom of movement associated with the loosened screws. The axial adjustment is performed by a pressman to position the strippers accurately next to and between the rotating buckets at an appropriate location along the shaft. When a stripper 118 is in a desired axial position along rectangular bar 64, and a desired distance of the stripping surface 27 from the axis of the bar 64 is achieved, the screws 126, 128 are moved to their locked positions and the stripper 118 is secured in place. Note that adjacent strippers can be aligned with respect to each other by lining up lines 151. In the locked position, the screws 126, 128 draw the brackets 124, 125 closer together therefore grippingly engaging the bar 64.

The axial adjustment of sliding each stripper 18 along the respective bar 64 to the proper location relative to the rotating bucket assembly and adjustment of the position of the stripper in direction 149 can be made either with the folder 12 running or stopped. The area in the folder 12 that has to be reached by the press operator during adjustment is out of the way of the rotating bucket assemblies and therefore can be safely manipulated by the press operator while the folder 12 is running. It is advantageous to be able to make the axial adjustment while the folder 12 is running because the press operator can more effectively fine tune the adjustment.

The axial adjustment of sliding the strippers 18 along the bar 64 can also be used to move a stripper 18 to a storage location along the bar 64 instead of having to completely remove the stripper 18 and nut 24 completely from the bar 64 when the stripper 18 is not needed to run a particular width signature. Moving a stripper 18 to a storage location is easier and quicker to perform than removing the stripper and nut entirely, and the unused stripper 18 will not get lost or damaged before it is next needed.

As previously stated, the mount assembly for the first embodiment of the stripping mechanism will be described below. Also, the pivotable adjustment of the strippers around the shaft assembly 116 axis will be described below.

Figure 5:
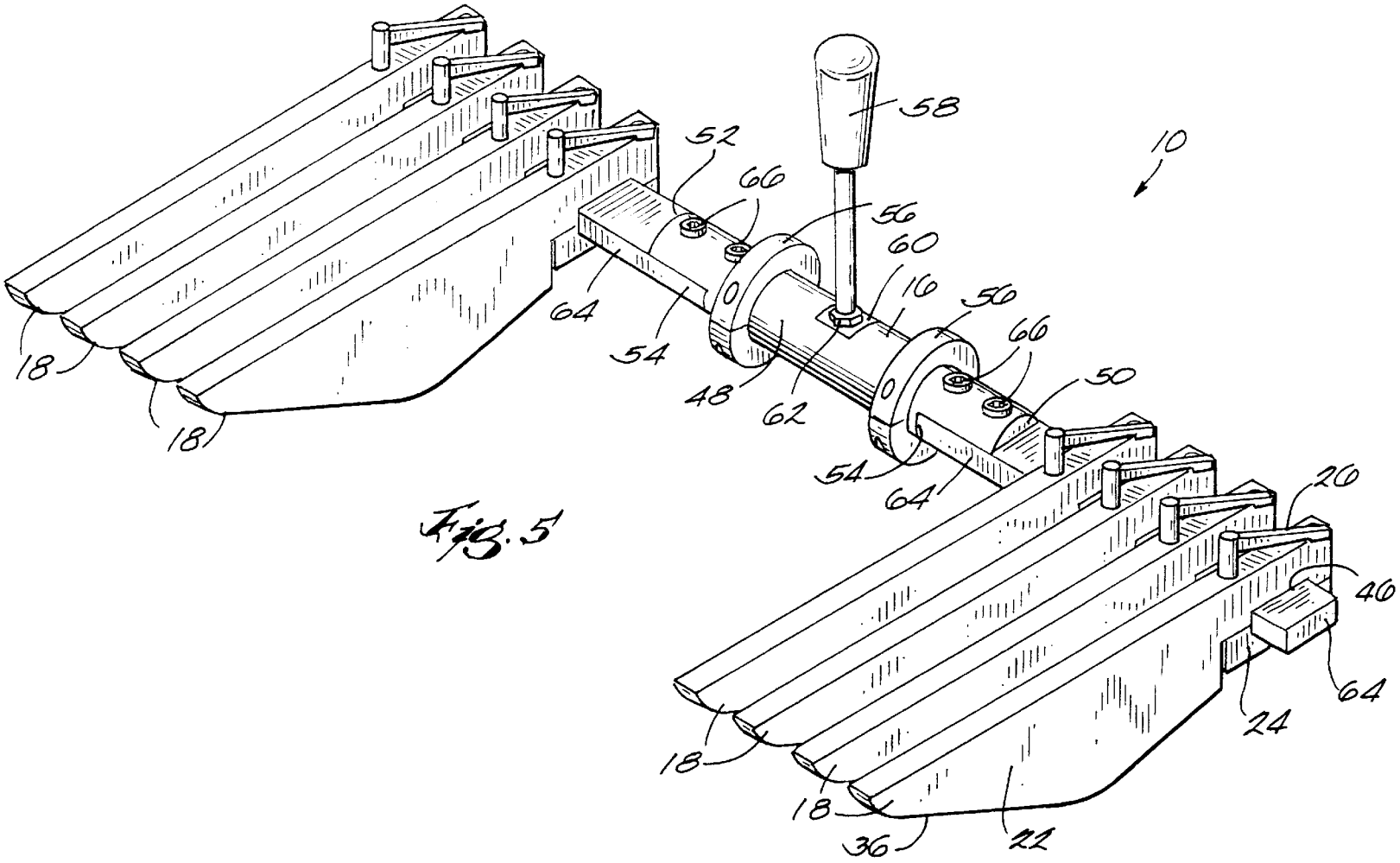
FIG. 5 is a perspective view of the shaft assembly and a plurality of signature strippers mounted thereon.
Figure 6:
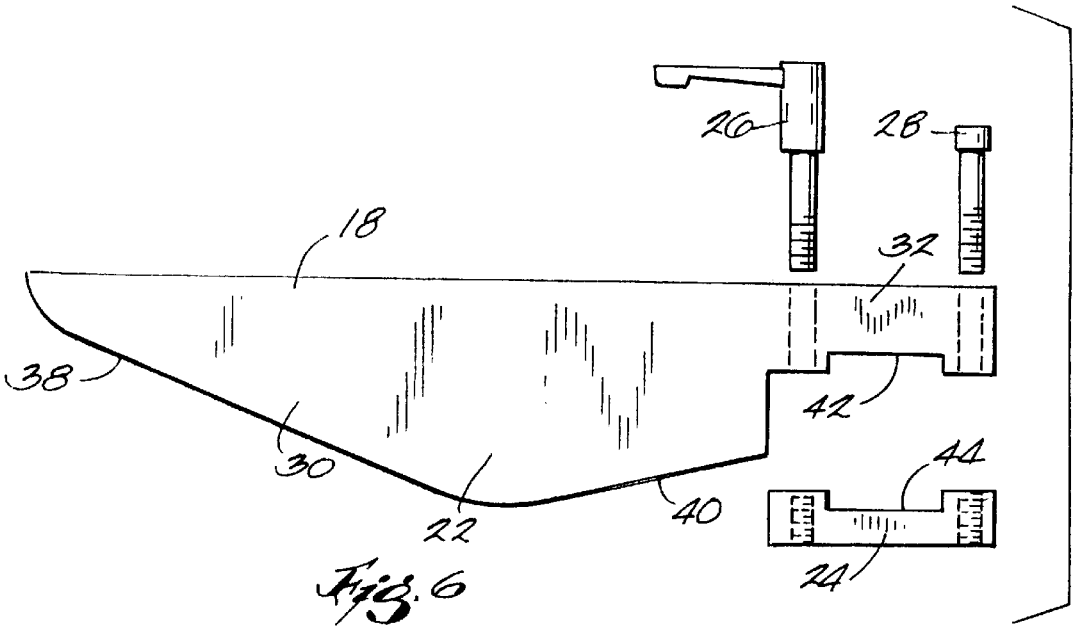
FIG. 6 is a plan view of an individual signature stripper of the second embodiment of the signature stripping mechanism.

Referring now to FIGS. 5 and 6, the second embodiment of the signature stripping mechanism will be described. Signature stripping mechanism 10 includes a shaft assembly 16, a plurality of strippers 18 slidably mountable on the shaft assembly 16, and a mount assembly 20 (FIG. 8) for pivotally mounting the shaft assembly to the folder 12.

The shaft assembly 16 is similar to that described above in connection with shaft assembly 116. Shaft assembly 16 includes a center shaft 48 having ends 50 and 52. Each end 50, 52 includes a C-shaped slot 54. The two C-shaped slots 54 are in line with each other. An axially adjustable collar 56 is mounted around the center shaft 48 adjacent each end 50, 52. A handle 58 extends radially outwardly from the center shaft 48 and is secured to a recess 60 in the center shaft 48 with threads and a nut 62. A rectangular bar 64 is positioned at each end 50, 52 of the center shaft 48 such that one bar 64 is housed in each C-shaped slot 54. A pair of screws 66 secure the bars 64 to each respective end 50, 52 of the center shaft.

Each stripper 18 includes a body 22, a U-shaped bracket 24, an adjustment screw handle 26 and a screw 28. The body 22 includes a stripper portion 30 and a mounting portion 32. The body 22 is configured to optimally strip signatures from bucket assemblies thus permitting a faster running speed of the folder 12. The body 22 includes a stripping surface 36. Stripping surface 36 can take a variety of shapes. In this embodiment, stripping surface 36 is shown having a first ski-shaped portion 38 and a second curved portion 40. It is the first curved portion 38 that is the primary stripping surface for stripping a signature from a rotating bucket assembly. Because the signature passes underneath the stripper 18 from the first curved portion 38 to the second curved portion 40, the second curved portion 40 is configured to avoid any jam-ups on the conveyor 14 that is positioned below the buckets. The mounting portion 32 of the body 22 is adjacent the second curved portion 40 and includes a rectangular notch 42.

The stripper body 22 is preferably fabricated from ¾ inch thick aluminum, Teflon or Delrin plate. However, it should be noted that other widths of material and/or other materials can also be used. For example, if space is limited between rotating buckets, the body 22 could be fabricated at ½ inch thick. Alternate material for the stripper body 22 could include, for example, steel that is hard chrome plated or aluminum plate that is coated with a hard coating such as Magnaplate HCR with a surface buildup of 0.002 inches.

The bracket 24 includes a rectangular notch 44. The bracket 24 is secured to the body 22 such that the rectangular notch 42 of the mounting portion 32 is adjacent to and aligned with the rectangular notch 44 of the bracket 24. The aligned two notches 42 and 44 form a rectangular aperture 46 (FIG. 6) that prevents rotation of stripper 18 around the axis of the shaft assembly 16. The bracket 24 is secured to the body 22 using the screws 26, 28 that extend through clearance holes of the mounting portion 32 and into the tapped bracket 24.

The screw handle 26 extends through clearance holes of the mounting portion 32 and into the tapped bracket 24 and provides axial adjustability to the stripper 18. Preferably, the screw handle 26 is a conventional KIPP handle, however, other types of screw handles can also be employed. The screw handle 26 uses an internal spline so that the final handle position (when the screw handle 26 is in its locked or tightened position) can be adjusted by the press operator to the most convenient position for handle operation. For instance, the screw handle 26 can be positioned at about a thirty degree angle to the stripper body 22 when viewed from the top. All of the screw handles 26 can be adjusted via the internal spline so that in their locked positions, they are all parallel with each other.

If a narrow stripper body 22 is required because the space between buckets is limited, the screw handle 26 can be replaced with an ordinary screw to save space. Alternate, similar designs for the mounting of the strippers 18 are also possible and known to those skilled in the art.

To mount the strippers 18 on the shaft assembly 16, the rectangular aperture 46 is positioned to surround one of the bars 64 by sliding the stripper 18 onto the bar 64. In this orientation, the rectangular notch 42 in body 22 of the stripper 18 fits tightly over the top of one of the bars 64. The notch 42 aligns each stripper 18 so that all of the strippers 18 and stripping surfaces 36 on the bar 64 are aligned in the same orientation with respect to bar 64 and thus to each other. The notch 42 places the stripping surface 36 of each stripper 18 at the correct location and angle with respect to the bucket assembly and with respect to the signatures that are processed through the bucket assembly. The two slots 54 on opposite ends of center shaft 48 are lined up with each other so all strippers and stripping surfaces on both sides of the handle 58 are properly aligned with each other.

When the screw handle 26 is in an unlocked or loosened position, the stripper 18 is axially slidable along the bar 64 and can be positioned at any location along the bar. This adjustment is used to position the strippers accurately next to and between the rotating buckets and is performed by the press operator. When a stripper 18 is in a desired axial position along rectangular bar 64, the screw handle 26 is moved to its locked position and the stripper 18 is secured in place. In the locked position, the screw handle 26 draws the bracket 24 closer to the body 22 (but not touching) therefore grippingly engaging the bar 64 between the mounting portion 32 of the body 22 and the bracket 24.

Thus, when the screw handle 26 is in an unlocked position, each stripper 18 has only one individual degree of freedom, that of moving axially along the bar 64. It should be noted that when the screw handle 26 of an individual stripper 18 is loosened to its unlocked position, the transverse location of the stripping surface 36 from the bar 64 and the angle of the stripping surface 36 cannot be accidentally disturbed or lost. Also, the distance of stripping surface 36 from the axis of bar 64 and the angle of the stripping surface 36 of the repositioned stripper 18 is lined up automatically with the rest of the strippers 18 on the same bar 64 because all of the strippers 18 use the same common bar 64 to align them with each other and with the adjacent fan assemblies. The axial adjustment has no physical restrictions except the length of the bar 64.

There are other configurations for the shaft and the strippers such that the strippers can be mounted on the shaft so that each of the strippers is non-rotatable relative to the shaft and such that each of the strippers is slidably positionable along the shaft. For example, a substantially round shaft having a keyway and a stripper having a key portion complementary to the keyway would also allow one degree of freedom of movement of the stripper with respect to the shaft while keeping all of the strippers aligned with one another.

The axial adjustment of sliding each stripper 18 along the respective bar 64 to the proper location relative to the rotating bucket assembly can be made either with the folder 12 running or stopped. The area in the folder 12 that has to be reached by the press operator during adjustment is out of the way of the rotating bucket assemblies and therefore can be safely manipulated by the press operator while the folder 12 is running. It is advantageous to be able to make the axial adjustment while the folder 12 is running because the press operator can more effectively fine tune the adjustment.

The axial adjustment of sliding the strippers 18 along the bar 64 can also be used to move a stripper 18 to a storage location along the bar 64 instead of having to completely remove the stripper 18 and nut 24 from the bar 64 when the stripper 18 is not needed to run a particular width signature. Moving a stripper 18 to a storage location is easier and quicker to perform than removing the stripper and nut entirely, and the unused stripper 18 will not get lost or damaged before it is next needed.

When it is necessary to remove a stripper from the shaft assembly, the usual procedure is to completely loosen screw handle 26 and screw 28 and to remove stripper 18 and nut 24. Similarly, an additional stripper 18 can be easily added to the shaft assembly 16. Adding or removing strippers 18 may be necessary when the folder 12 is being set up to run wider or narrower signatures than the previous job. For example, for a job processing 12" wide signatures, five rotating buckets and four strippers 18 may be preferred. For a job processing 6" wide signatures, two rotating buckets and two strippers 18 may be preferred.

Figure 7:
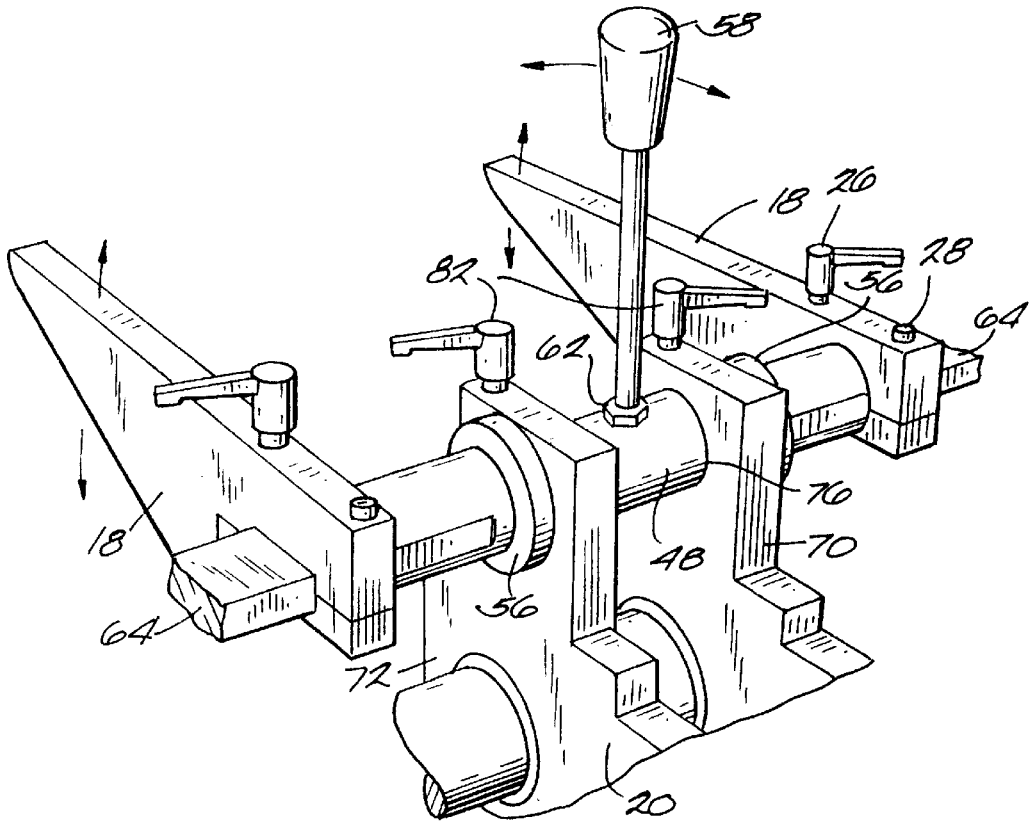
FIG. 7 is a perspective view of a portion of the second embodiment of the stripping mechanism particularly showing the mount assembly.
Figure 9:
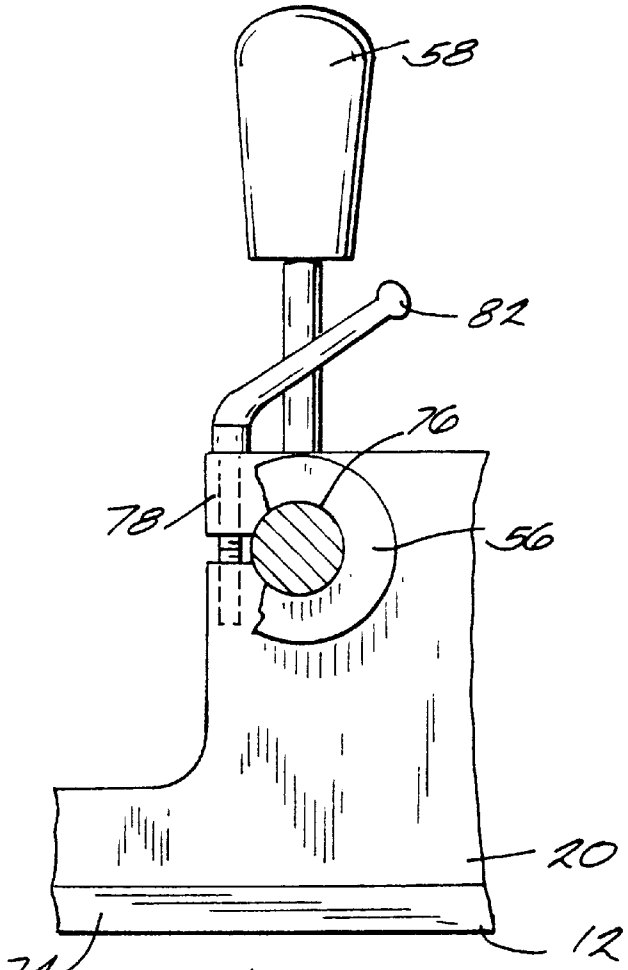
FIG. 9 is a side view of the mount assembly.
Figure 8:
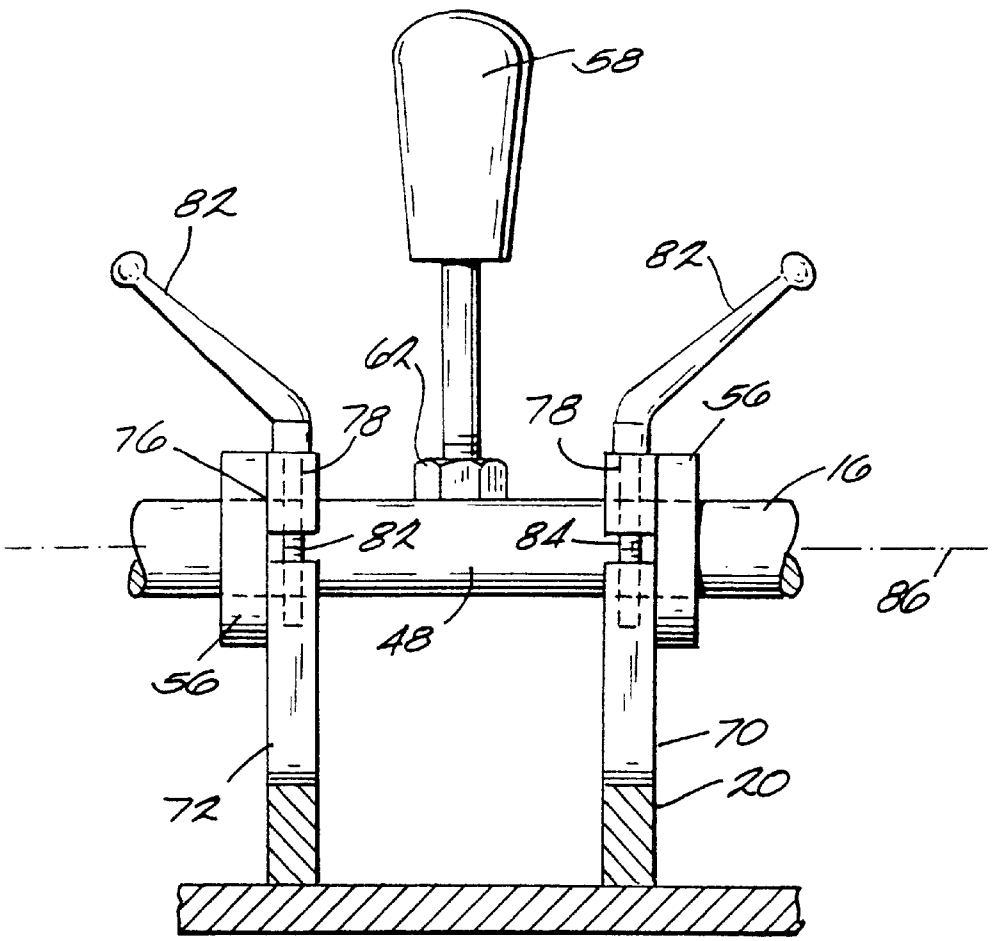
FIG. 8 is a front view of a portion of the mount assembly.

Turning now to the second stripper adjustment, this adjustment is one that simultaneously adjusts the angle or tilt of all the strippers 18 mounted on the shaft assembly relative to the signature path in the buckets. The purpose of this adjustment is to tilt the stripping surface 36 of the stripper to the best angle relative to an arriving signature 19. Referring now to FIGS. 7 through 9, the shaft assembly 16 is mounted to the stationary mount assembly 20. The mount assembly 20 preferably both enables the second pivotal adjustment of the strippers 18 as well as mounts the shaft assembly 16 to the folder 12.

The mount assembly 20 includes two vertical, spaced and generally parallel frames 70, 72 which are mounted to a horizontal floor plate 74 of the folder 12. Each frame 70, 72 includes a circular aperture 76 as well as a channel 78 in communication with the aperture 76. The center shaft 48 of the shaft assembly 16 is mountable in the apertures 76 and extends outwardly from each aperture 76. In this orientation, the handle 58 of the shaft assembly 16 should be positioned between the frames 70, 72 and one collar 56 should be positioned adjacent each frame 70, 72. The collars 56 prevent the axial movement of the shaft assembly 16 relative to the mount assembly 20.

A screw handle 82 is mounted through each frame 70, 72 such that the screw 84 of the screw handle 82 extends through the channel 78 to contract or expand the aperture 76. Alternatively, screws without handles could also be utilized. Each screw handle 82 has a locked position wherein the aperture 76 is contracted and an unlocked position wherein the aperture 76 is able to expand. By rotating both screw handles 82 to their unlocked position, the shaft assembly 16 is pivotable about a longitudinal axis 86 (FIG. 8) of the center shaft 48 by pulling back or pushing forward on the handle 58. To secure the shaft assembly 16 in a new position, the handles 82 are turned to their locked position so that the channel 78 and therefore the aperture 76 is squeezed together holding the shaft assembly 16 in the desired angular location. Other methods of locking the shaft assembly 16 in the pivoted position, as are known to those in the art, can also be employed.

Another way to make the pivotal adjustment involves partially loosening the screw handles 82 to such an extent that the handle 58 can be pulled or pushed with considerable operator effort. With the screw handles 82 only partially loosened, both apertures 76 of the frames 70, 72 are still squeezing the center shaft 48 of the shaft assembly 16 hard enough so that the previous pivotal adjustment is maintained. In this adjustment method, the operator adjusts the angular shaft position and the shaft assembly 16 is prevented from pivoting through its full range of motion; i.e., rotating all the way down because of the weight of all the strippers 18 that tend to accidentally turn shaft assembly 16 about axis 86. When the pivotal adjustment is completed and the strippers 18 are working properly to strip signatures from the bucket assemblies, then the screw handles 82 can be completely rotated to the locked position to securely maintain the position of the shaft assembly 16.

The pivotal adjustment can easily, quickly and safely be made when the folder 12 is stopped or running. However, the best results and quicker adjustments are obtained when the folder 12 is running because the operator receives immediate feed-back on how well the pivotal adjustment is working to process signatures. The handle 58 and both screw handles 82 are located between the frames 70, 72 which is out of the way of the rotating buckets.

If the folder 12 has more than one stripper, the pivotal adjustment to the strippers 18 is a quick and easy adjustment to make because one pull or push on the handle 58 adjusts all of the strippers 18 mounted on both bars 64 of the shaft assembly 16 simultaneously and by an equal amount. This eliminates having the press operator adjust the angle of each stripper 18 individually.

Figure 10:
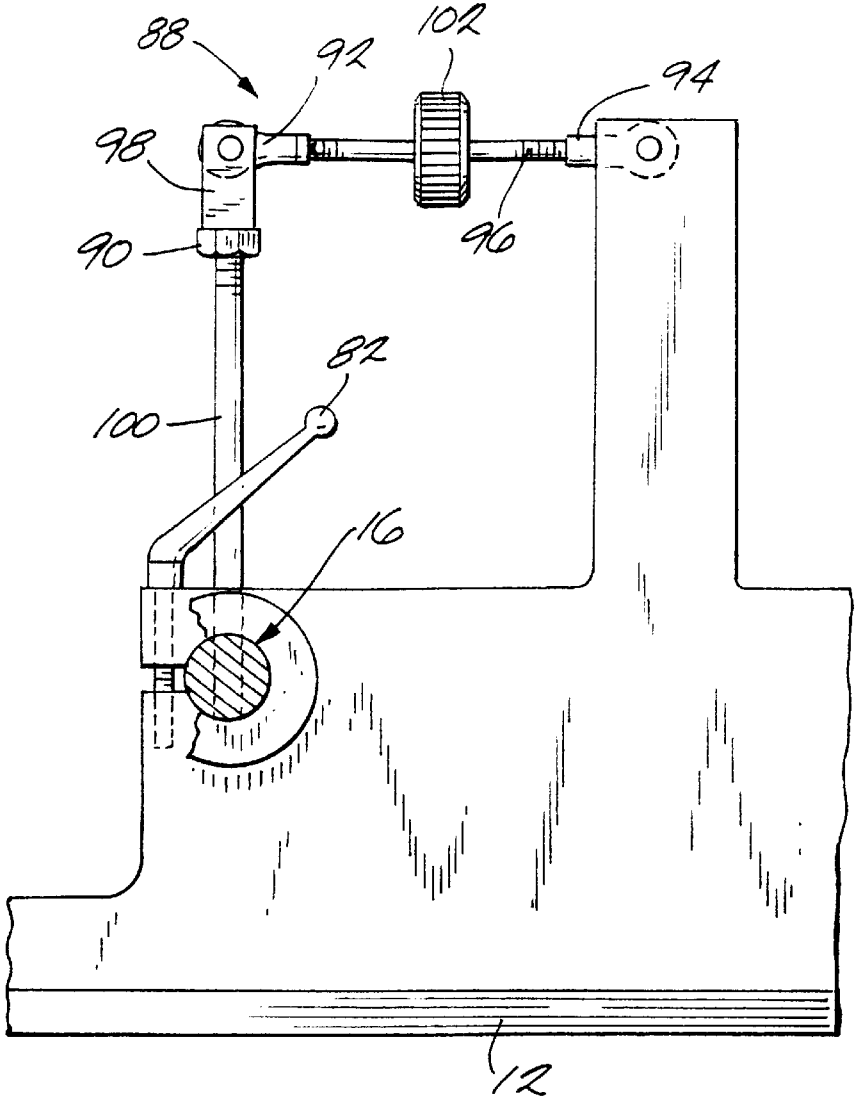
FIG. 10 is a side view of a second embodiment of the mount assembly.

Referring now to FIG. 10, a second embodiment 88 of the mount assembly 20 is shown. In this embodiment, instead of pivoting the shaft assembly 16 with a handle 58 manually as explained above, an adjustable linkage 90, which requires less muscle power from the operator, is employed to perform the same adjustment. Numerous variations of linkage 90 can be used as known in the art. As shown in FIG. 10, the linkage 90 includes two rod ends 92, 94 with a threaded adjusting bar 96 therebetween. The end 94 is pivotably connected to the stationary folder 12 and the other end 92 pivotably connected to a lever 98 which is turned by a handle 100. The pivotal adjustment of shaft assembly 16 is made by turning the threaded adjusting bar 96 with an adjustment knob 102, fixedly part of adjusting bar 96, between the two rod ends 92, 94 and locking it with two jam nuts against the rod ends 92, 94.

Figure 11:
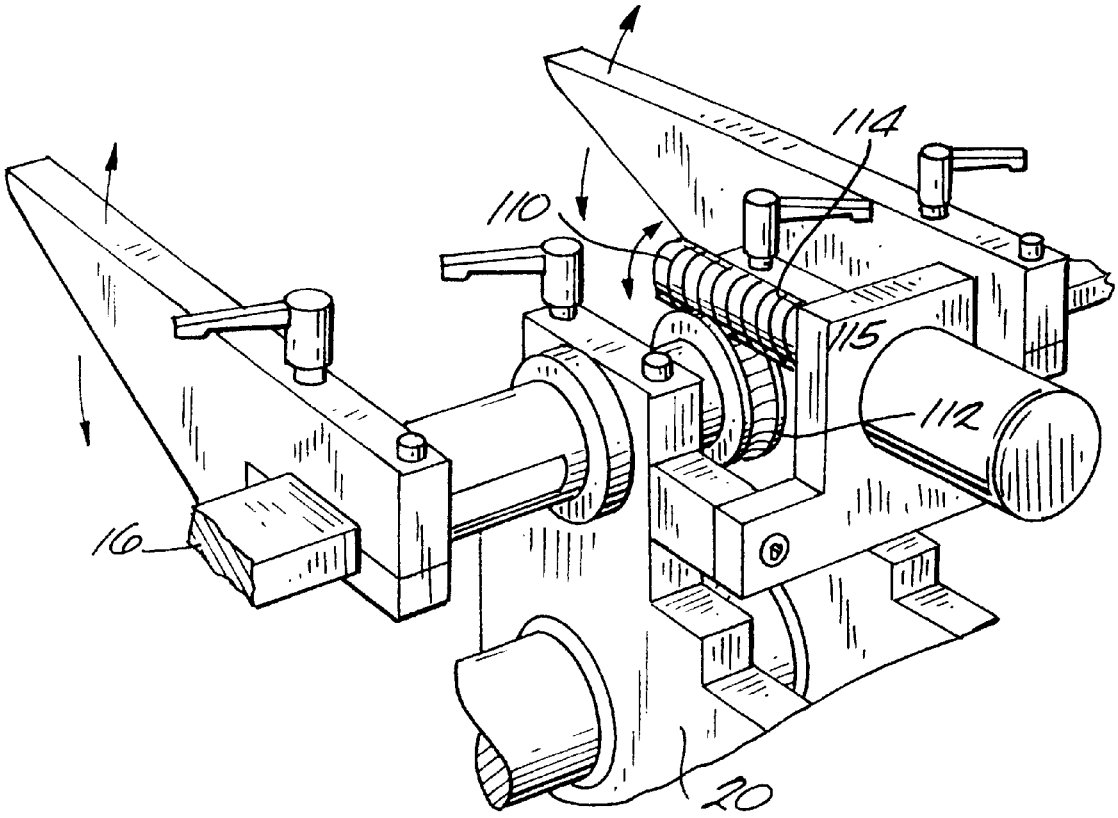
FIG. 11 is a perspective view of a third embodiment of the mount assembly.

In another embodiment of the mount assembly 20 shown in FIG. 11, a worm gear mechanism 110 could also be employed to make the pivotal adjustment. The mechanism 110 includes a worm gear 112 mounted fixedly on the shaft assembly 16 and a mating worm 114 that can be turned attached to a stationary plate 115. The mating worm 114 can be turned in the direction of the arrows.

It should be noted that the pivotal adjustment could also be made using a motor, as is well known in the art. This arrangement would allow remote adjustment by the press operator while permitting observation of the angle of the stripping surface 36 with respect to the signature path in the buckets.

The stripping mechanism 10 of the present invention includes the following advantages. Less operator skill and press knowledge are required to make the stripper adjustments because the adjustment of the angle and position of the stripping surface of each stripper has been incorporated into the shape of the stripper body and is therefore non-adjustable. The stripper adjustments themselves can be made easily, quickly and safely while the folder is stopped or running. Making the stripper adjustments while the folder is running enables more efficient adjustments to be made because the operator receives immediate feedback of how well the adjustment is working to process signatures. The various adjustments to the strippers have reduced number of degrees of freedom of movement which enables the adjustments to be made more quickly and more accurately.

The strippers can be moved closer together for jobs where the width of the signatures to be processed is small. The adjustment handles that are utilized are convenient and do not interfere with each other even when the strippers are spaced very close together. The strippers can be fabricated of varying thicknesses for differing space restrictions such as when a narrow signature is being processed through the folder. The individual strippers are easy and quickly added or removed entirely from the folder when a new signature width requires a different folder setup.

The pivotal adjustment of all of the strippers relative to the bucket assemblies can be adjusted simultaneously and equally with one pull or push of the main adjustment handle. With more efficiently adjusted strippers, the folder can be operated at a higher speed thus increasing production capacity. Both the axial and pivotal adjustments to the strippers are safe to make while the folder is running or while the folder is stopped.

It is understood that the invention is not confined to the particular construction and arrangement of parts herein illustrated and described, but embraces all such modified forms thereof as may come within the scope of the following claims. It will be apparent that many modifications and variations are possible in light of the above teachings. It therefore is to be understood that within the scope of the appended claims, the invention may be practiced other than is specifically described. Alternative embodiments and variations of the method taught in the present specification may suggest themselves to those skilled in the art upon reading of the above description. Various other features and advantages of the invention are set forth in the following claims.

What is claimed is:

1. A mechanism for the delivery of printed products from a folder, the mechanism comprising:

a plurality of buckets rotatably mounted on a bucket shaft in spaced relation to one another in an axial direction, said buckets each having a plurality of slots for receiving signatures, a stripper shaft parallel to said bucket shaft and having a mounting portion, and at least one stripper for stripping signatures from the bucket slots and mounted on said stripper shaft such that said stripper is non-rotatable relative to said stripper shaft and slidably positionable along said mounting portion.

2. A mechanism as recited in claim 1, wherein said at least one stripper is a plurality of strippers.

3. A mechanism as recited in claim 1, wherein said at least one stripper has a stripping surface that is ski-shaped.

4. A mechanism as recited in claim 1, wherein said tripper shaft has a pivot axis and said mechanism further includes a mount assembly for mounting said stripper shaft such that said at least one stripper is pivotal about said pivot axis.

5. A mechanism as recited in claim 4, wherein said mount assembly includes a lever portion.

6. A mechanism as recited in claim 5, wherein said mount assembly further includes an adjustable linkage between said lever portion and a fixed plate.

7. A mechanism as recited in claim 4, wherein said mount assembly includes a worm gear fixedly mounted to said stripper shaft and a mating worm that can turn attached to a fixed plate.

8. A mechanism as recited in claim 1, wherein said mounting portion of said shaft is rectangular in cross-section.

9. A mechanism as recited in claim 1, wherein said stripper shaft has a pivot axis, said stripper includes a stripping surface, and wherein said mechanism further includes means for adjusting the distance between said pivot axis and said stripping surface.

10. A stripping mechanism for stripping printed products from a rotating bucket in a folder of a printing press, said mechanism comprising:

a shaft having a mounting portion and a pivot axis;

a plurality of strippers mounted on said mounting portion such that each of said strippers is non-rotatable relative to said shaft and such that each of said strippers is slidably positionable along said shaft; and a pivoting assembly connected to said shaft, said pivoting assembly enabling said shaft to pivot about said pivot axis such that all of said plurality of strippers on said shaft are simultaneously pivoted with said shaft.

11. The stripping mechanism as recited in claim 10 wherein each of said strippers has a stripping surface that is ski-shaped.

12. The stripping mechanism as recited in claim 10 wherein said pivoting assembly includes at least one stationary plate that supports said shaft.

13. The stripping mechanism as recited in claim 12 wherein said pivoting assembly includes a lever portion.

14. The stripping mechanism as recited in claim 13 wherein said pivoting assembly further includes an adjustable linkage between said lever portion and said stationary plate.

15. The stripping mechanism as recited in claim 12 wherein said pivoting assembly further includes a worm gear fixedly mounted to said shaft and a mating worm that can turn attached to said stationary plate.

16. The stripping mechanism as recited in claim 12 wherein said at least one stationary plate includes an aperture into which the shaft is positioned and supported for angular adjustment of the shaft and the plurality of strippers and wherein the size of the aperture can be varied to allow the shaft to rotate and prevent the shaft from rotating.

17. The stripping mechanism as recited in claim 16 wherein said at least one stationary plate includes a screw, wherein said screw has a first position wherein said shaft is not pivotable within said aperture and a second position wherein said shaft is pivotable within said aperture.

18. The stripping mechanism as recited in claim 10 wherein said shaft includes a handle that aids in pivoting said shaft.

19. The stripping mechanism as recited in claim 10 wherein each stripper includes a body portion and a bracket, and said body portion and said bracket cooperate to define a mounting area in which said mounting portion of said shaft is positioned.

20. The stripping mechanism as recited in claim 10 wherein each of said strippers includes an adjustment handle, wherein when said handle is in a first position said stripper is slidable along said shaft, and wherein when said handle is in a second position said stripper is prevented from sliding along said shaft.

* * * * *